United States Patent [19]

Nemeth

[11] 3,959,184

[45] May 25, 1976

[54] MODIFIED COPPER-ALUMINUM SUPPRESSOR ELEMENT

[75] Inventor: Joseph Nemeth, St. Clair Shores, Mich.

[73] Assignee: Champion Spark Plug Company, Toledo, Ohio

[22] Filed: Apr. 8, 1974

[21] Appl. No.: 458,776

[52] U.S. Cl. ..... 252/521; 252/518; 313/118; 315/58

[51] Int. Cl.[2] ..... H01T 13/00; H01B 1/06; H01C 1/06

[58] Field of Search ..... 252/521, 518; 313/118; 315/58

[56] References Cited

UNITED STATES PATENTS

| | | | |
|---|---|---|---|
| 2,251,745 | 8/1941 | Lehfeldt | 252/521 |
| 2,837,487 | 6/1958 | Huttar | 252/518 |
| 2,864,884 | 12/1958 | Counts et al. | 315/58 |
| 2,902,747 | 9/1959 | Reiter | 313/118 |
| 3,737,718 | 6/1973 | Rempes | 315/58 |

*Primary Examiner*—Benjamin R. Padgett
*Assistant Examiner*—Josephine Lloyd
*Attorney, Agent, or Firm*—John C. Purdue

[57] ABSTRACT

An improved ceramic article useful after firing as an electrical suppressor element, especially suitable for use in spark plugs, is disclosed. The suppressor element is a copper-aluminum composition modified with a magnesium, calcium, strontium or barium metal compound. The numerical value of the atom ratio of the article, $$Cu/M+Al$$

where M represents magnesium, calcium, strontium or barium is from 0.5 to 4. The atom ratio of M to Al is from about 0.5:1 to 2.0:1. The temperature coefficient of resistance of the suppressor, defined by $$n = 2.303 \log \frac{(R_2)}{(R_1)} \quad \frac{(1)}{(T_2 - T_1)} \times 100 \text{ in } \%/°C$$

is between about −0.1%/°C and −1.0%/°C.

2 Claims, 2 Drawing Figures

THE EFFECT OF Cu/(Sr+Al) ATOM RATIO UPON R 25°C @ 1000V & n.

THE EFFECT OF Sr/Al ATOM RATIO UPON R 25°C @ 1000V. & n.
(Cu/Sr ATOM RATIO ≃ 4)

MODIFIED COPPER-ALUMINUM SUPPRESSOR ELEMENT

BACKGROUND OF THE INVENTION

This invention relates to a new and improved green ceramic article which can be fired to produce an improved suppressor element for use at elevated temperatures.

Suppressor elements suitable for use in spark plugs must have good mechanical and electrical stability at high temperatures, a wide operating temperature range, uniform resistance value and good suppression of high frequency oscillations associated with spark discharge in ignition systems.

The problem of eliminating radio frequency radiation from the high voltage ignition system of internal combustion engines has been of increasing concern in recent years because such radiation produces interference with the use of radio channels for communication and navigation. This problem has been accentuated by the increasing number of automobiles, boats and aircraft and the simultaneous increase in the use of radio frequency equipment in both communications and navigational equipment.

The typical ignition system for an internal combustion engine includes a set of breaker points, a capacitor, an ignition coil, a spark plug, and connecting wires. When the breaker points are closed, a battery causes a current to flow in a primary winding of the ignition coil, thereby establishing a magnetic field about, and storing energy in, a ferrous core in the ignition coil. When the breaker points are opened, the magnetic field collapses and produces a high voltage across a secondary winding of the ignition coil. The high voltage is applied to, and arcs across, a spark gap in the spark plug, greatly decreasing the impedance of the gap. The secondary coil winding and the low impedance spark gap form a resonant circuit which oscillates as the energy stored in the core is dissipated. The oscillations are in the radio frequency spectrum and may cause severe noise and interference in both communications equipment and navigational equipment.

In the past, it has been found that random radio frequency radiation from the ignition system of internal combustion engines may be greatly reduced or eliminated by placing a resistance element in the high voltage ignition circuit for each spark plug. The resistance element may be positioned in the bore of a spark plug insulator, in series with the spark plug center electrode, or may be placed at some other convenient location in the ignition system, such as in a distributor rotor or distributed in the high voltage ignition cables.

Prior art suppressors, other than distributed resistances found in ignition cables, are generally either of a carbon rod type, of a wire wound type, of a sintered resistive rod type or of a resistive mass fired between the glass seals in the center electrode bore through a spark plug insulator. Each of the different types of suppressors has advantages and disadvantages. The carbon capsule suppressor is, for example, relatively inexpensive compared to a wire wound suppressor. The carbon capsule usually consists of carbon or graphite dispersed in a resinous binder. However, when the carbon capsule suppressor is placed in a spark plug and is heated to perhaps over 450°F or more during operation of the internal combustion engine, the carbon tends to oxidize, resulting in an open circuit due to rapidly increasing resistance levels as the carbon oxidizes, until a value of infinity is reached. Vitreous type carbon suppressor elements, formed from clay, talc and a refractory material having carbon distributed therein, have been used extensively. However, it is difficult to prepare such suppressors having uniform resistance values.

Wire wound suppressors do not possess as high a resistance level as carbon suppressors because they suppress by inductive impedance rather than by resistance impedance. However, the wire wound suppressor is expensive compared to the carbon suppressor and presents problems both in arcing and in connecting terminals to the wire ends. Wire wound suppressors are also bulky and, therefore, difficult to use in smaller size spark plugs.

Suppressor elements suitable for use in an internal combustion engine must withstand severe operating conditions involving pulsating high power loadings. The suppressor element must operate well at temperatures ranging from 200° to greater than 400°F at 15,000 volts pulsating direct current.

In an attempt to overcome difficulties encountered with the use of carbon, other suppressor composition systems have been suggested. For example, U.S. Pat. Nos. 2,864,773 and 2,969,582 disclose the use of titanate and stano-titanate type materials modified to obtain desired electrical characteristics.

The Radio Manufacturers Association (RMA) and the Society of Automotive Engineers (SAE) have directed efforts toward determining limits for interference from internal combustion engines in communication and navigation equipment. As a result, the SAE has adopted limits for impulsive type interference and has included these limits in a uniform test standard SAE J551b, "Measurement of the Vehicle Radio Interference".

It is known that significant improvements can result in operation of communication and navigation equipment when engine-driven apparatus comply with the limits set forth in SAE J551b. Communications apparatus that operate in the frequency range 20–1000 megahertz which might be susceptible to radio frequency interference are very high frequency (VHF) television, ultra high frequency (UHF) television, frequency modulated (FM) radio, aircraft navigation and communication, amateur radio, telemetry, high frequency (HF) communications, UHF radar, and others.

The testing equipment required for SAE J551b is complex and expensive. However, satisfactory testing results can be obtained by comparing test samples with a wire wound suppressor and a carbon suppressor having known resistance and suppressing properties, and measuring the field intensity per unit band width within a given frequency range.

Copper oxide suppressor elements are known in the art. However, such suppressor compositions are unstable and exhibit a large increase in resistance when exposed to higher temperatures.

SUMMARY OF THE INVENTION

The instant invention is based upon the discovery that a copper and alumina composition can be controlled and modified by means of incorporating a magnesium, calcium, strontium or barium metal compound into the composition in such a manner as to produce after firing a suppressor element having a low negative temperature coefficient of resistance and good suppression characteristics. The composition is modified in such a manner that the numerical value of the atom ratio Cu/(M + Al), where M is magnesium, calcium, strontium or barium, is maintained in the range of 0.5 to 4. The M/Al atom ratio has a value between 0.5:1 to 2.0:1. The temperature coefficient of resistance of the semiconductor is between −0.1%/°C and −1.0%/°C.

It is therefore an object of the present invention to provide a composition that has, after firing, a low temperature coefficient of resistance.

It is a further object of the present invention to provide a suppressor composition that has a high temperature stability.

It is a still further object of the present invention to provide a suppressor composition that is capable of suppressing unwanted radio frequency radiation in internal combustion engine ignition systems.

Other objects and advantages of the invention will become apparent from the following detailed description.

DESCRIPTION OF THE PREFERRED EMBODIMENTS

EXAMPLE I

A series of copper-aluminum semiconductors designated as samples A through E, utilizing additions of strontium, was prepared by mixing together the materials listed below and firing to the temperature indicated. Test results obtained are listed in Table I.

As indicated in the table, the Sr/Al atom ratio was maintained constant at 1.09 ± 0.04:1 while the Cu/(Sr + Al) atom ratio was varied between about 0.8 and 4.

steadily decreases. The value of $R_{25°C}$ varies between about 1 to 20KΩ.

The resistance at any temperature (from 25°C to 250°C) can be expressed by the equation:

$$R_T = R_{25°C}\, e^{n\,(T-25°)}$$

where $R_T$ is the resistance at some temperature T, $R_{25°C}$ is room temperature resistance and $n$ is the temperature coefficient of resistance. For copper-aluminum suppressors, $n$ (in %/°C is negative and defined by $$n = 2.303 \log_{10} \left( \frac{R_2}{R_1} \right) \left( \frac{1}{T_2 - T_1} \right) \times 10$$

Suppression testing results appear to indicate that a low value for temperature coefficient of resistance is a prerequisite for good suppressor materials. It is theorized that in an ignition system, as the circuit resistance increases, the oscillating current which is the cause of the radio frequency interference, decreases.

EXAMPLE II

A second series of copper-aluminum semiconductors, utilizing additions of strontium, was prepared as described in Example I. Test results obtained are listed in Table II.

As indicated in the table, the Cu/Sr atom ratio was maintained constant at approximately 4:1, while the Sr/Al atom ratio was varied between about 0.66:1 to 1.65:1.

Figure 2:
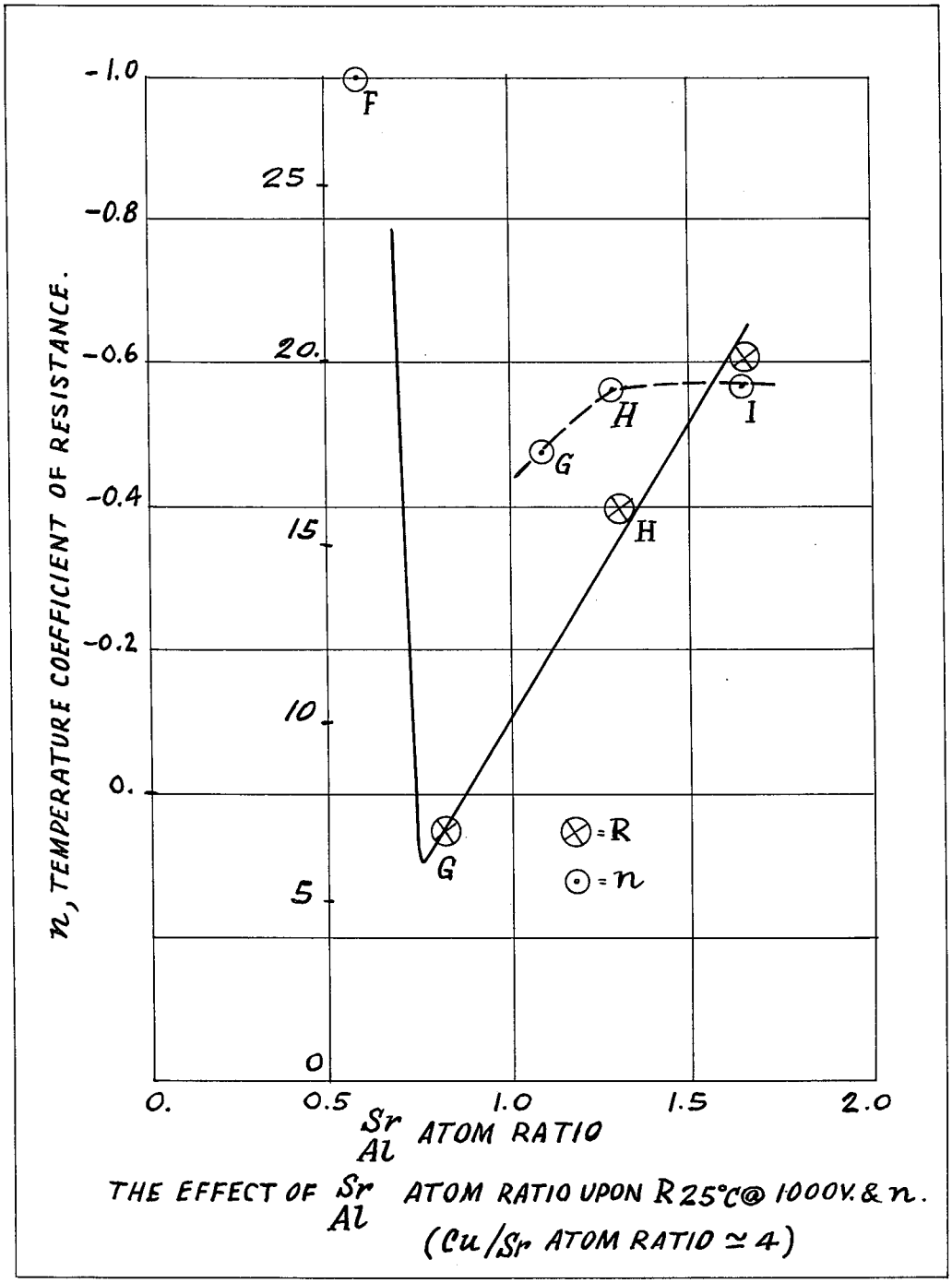
FIG. 2 is a representation of the curve obtained from the measurement of the temperature coefficient of resistance of a series of copper and aluminum suppressor elements showing the effect of varying the Sr/Al ratio while maintaining the Cu/Sr ratio at about 4:1.

The effect of varying the Sr/Al atom ratio is shown in FIG. 2. The effect upon resistance level is drastic; as the Sr/Al atom ratio approaches 0.5:1, the slope of the $R_{25°C}$ value versus the atom ratio becomes almost asymptotic. A comparison with Example I shows that much less control of the $n$ value is obtained in comparison to the control obtained by varying the Cu/(Sr + Al) ratio.

TABLE I

| Material Added | Atom | Atom Ratio Sample A | Sample B | Sample C | Sample D | Sample E |
|---|---|---|---|---|---|---|
| $Cu_2O$ | Cu | 63 | 63 | 63 | 63 | 63 |
| $SrCO_3$ | Sr | 40.5 | 32.5 | 24.5 | 16.5 | 8.5 |
| $Al_2O_3$ | Al | 38.5 | 30.5 | 22.5 | 15 | 7.5 |
| Sr/Al | | 1.05:1 | 1.07:1 | 1.09:1 | 1.10:1 | 1.13:1 |
| Cu/(Sr+Al) | | 0.80 | 1.00 | 1.34 | 2.00 | 3.94 |
| Sintering Temperature(2 hours) °F | | 1900–2300° | 1900–2300° | 2050–2100° | 1850–2200° | 2100° |
| $R_{25°C}$(1KV) | | 1 to 5KΩ | 2 to 11KΩ | 10 to 15KΩ | 12KΩ | 10KΩ |
| n | | −0.85 | −0.8 | −0.7 | −0.5 | −0.15 |

Figure 1:
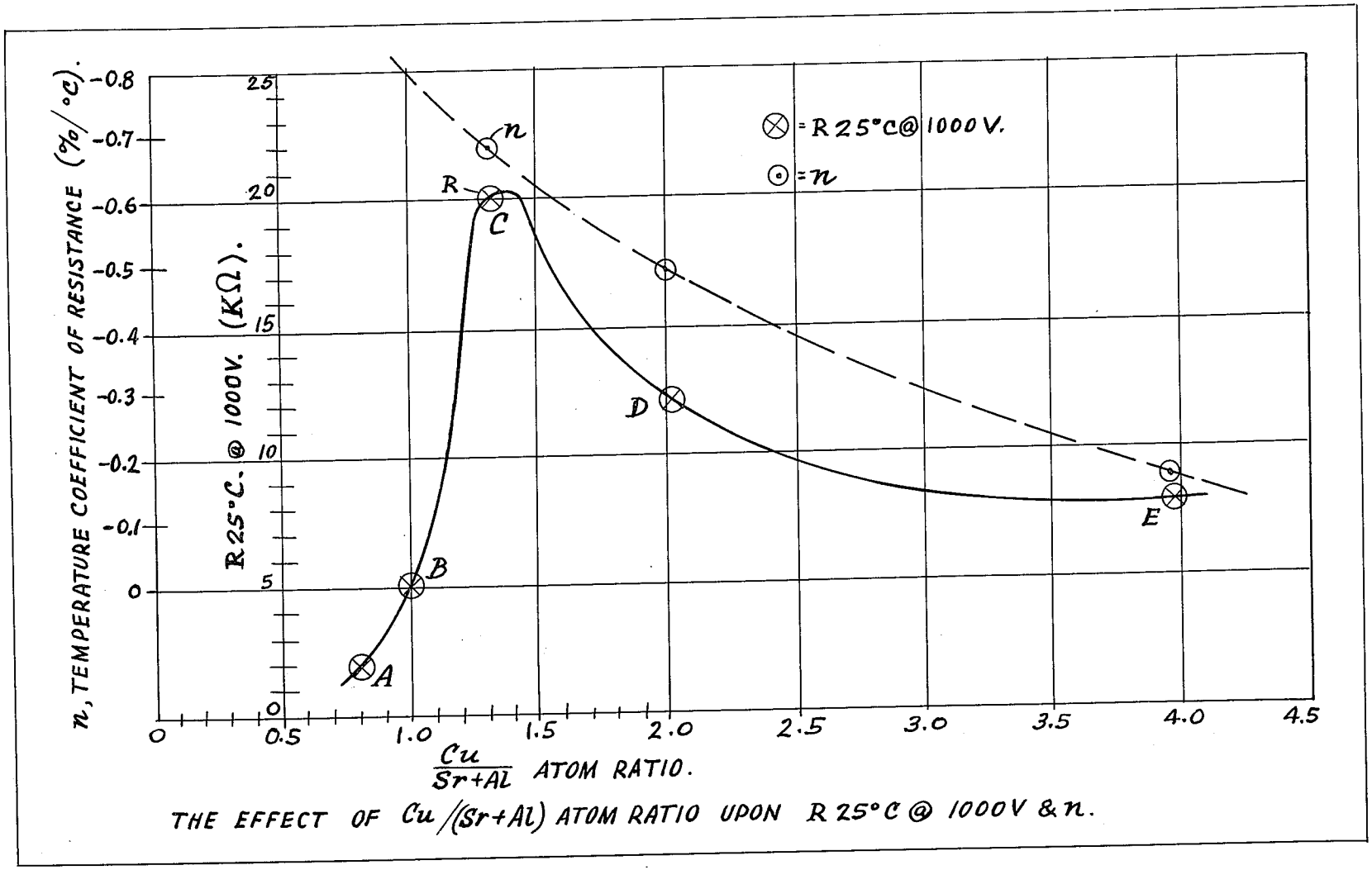
FIG. 1 is a representation of the curve obtained from the measurement of the temperature coefficient of resistance and room temperature resistivity of a series of copper and aluminum suppressor elements showing the effect of varying the Cu/(Sr+Al) atom ratio while maintaining a constant Sr/Al atom ratio of 1.05 ± 0.04.

The effect of varying the Cu/(Sr+Al) atom ratio while maintaining the Sr/Al atom ratio constant is shown in FIG. 1. As the ratio increases, the value of n

TABLE II

| Material Added | Atom | Atom Ratio Sample F | Sample G | Sample H | Sample I |
|---|---|---|---|---|---|
| $Cu_2O$ | Cu | 63 | 63 | 63 | 63 |
| $SrCO_3$ | Sr | 16.5 | 16.5 | 16.5 | 16.5 |
| $Al_2O_3$ | Al | 25 | 20 | 12.5 | 10 |
| Sr/Al | | .66:1 | 0.83:1 | 1.32:1 | 1.65:1 |
| Cu/Sr | | 3.82 | 3.82 | 3.82 | 3.82 |
| Cu/(Sr+Al) | | 1.52 | 1.73 | 2.17 | 2.38 |
| Sintering Temperature (2 hours) | | 1850–2300°F | 2200–2300°F | 1800–1950°F | 1800–2000°F |
| $R_{25°C}$ | | 15 to 25KΩ | 5 to 8KΩ | 15KΩ | 10 to 15KΩ |
| n | | −1.0 | −0.4 | −0.6 | −0.6 |

The suppressor effect is achieved by the modifying influence of the magnesium, calcium, strontium or barium metal atoms present with the aluminum atoms and copper atoms. It is apparent that the metal atoms can be incorporated into the article by addition of compounds other than those shown in the descriptive embodiment. For example, an alkaline earth oxide can be used; however, because of economic considerations, the metal carbonate is preferred. Similar considerations apply to the choice of a copper compound, where copper oxide is the preferred compound.

Since the elements in a given chemical group have similar properties, the carbonates of the other members of the Group II chemical group were tested as substitutes for strontium.

EXAMPLE III

A series of copper-aluminum semiconductor compositions, modified by the addition of strontium, magnesium, barium and calcium metal ions, respectively, was prepared as described in Example I. Additionally, a copper-aluminum semiconductor composition, not modified by the addition of magnesium, calcium, strontium or barium metal compounds was prepared as a control sample. Test results obtained are listed in Table III. As shown, addition of the modifying metal compound caused a significant decrease in the temperature coefficient of resistance; strontium appeared to be the most effective in reducing the value of $n$.

TABLE III

| Material Added | Atom | Atom Ratio Sample J | Sample K | Sample L | Sample M | Sample N |
|---|---|---|---|---|---|---|
| $Cu_2O$ | Cu | 63 | 63 | 63 | 63 | 63 |
| $SrCO_3$ | Sr | — | 16.5 | — | — | — |
| $MgCO_3$ | Mg | — | — | 16.5 | — | — |
| $BaCO_3$ | Ba | — | — | — | 16.5 | — |
| $CaCO_3$ | Ca | — | — | — | — | 16.5 |
| $Al_2O_3$ | Al | 15 | 15 | 15 | 15 | 15 |
| M/Al | | 0.0 | 1.10:1 | 1.10:1 | 1.10:1 | 1.10:1 |
| Cu/M | | 0.0 | 3.82 | 3.82 | 3.82 | 3.82 |
| Cu/M+Al | | 4.0 | 2.00 | 2.00 | 2.00 | 2.00 |
| Sintering Temperature (2 hours) °F | | 2150° | 1850–2200°F | 1850–2200°F | 1850–2200°F | 1850–2200°F |
| $R_{25°C}$ | | — | 12KΩ | 30KΩ | 20KΩ | 20KΩ |
| n | | −1.9 | −0.4 | −0.7 | −0.9 | −0.8 |

What I claim is:

1. A green ceramic article useful after firing as an electrical suppressor element, said article consisting essentially of copper oxide, alumina and a modifier which is a compound of M, where M is a metal carbonate selected from the group consisting of magnesium, calcium, strontium and barium wherein the relative proportions of the modifier and of alumina are such that the atom ratio of M to Al is from about 0.5:1 to 2.0:1, wherein the proportions of the copper oxide, alumina and modifier are such that the numerical value of the atom ratio Cu/(Al + M) is from about 0.5 to 4.0, and wherein the temperature coefficient of resistance of the fired suppressor which is defined by the expression $$n = 2.303 \log \frac{(R_2)}{(R_1)} \quad \frac{(1)}{(T_2 - T_1)} \times 100 \text{ in } \%/°C$$

is between about −0.1%/°C and −1.0 %/°C, depending upon the value of the Cu/(M + Al) atom ratio.

2. A green ceramic article useful after firing as an electrical suppressor element, said article consisting essentially of copper oxide, alumina and strontium carbonate, wherein the relative proportions of the strontium carbonate and alumina are such that the atom ratio of strontium to aluminium has a value of about 0.5:1 to 2.0:1, where in the proportions of the copper oxide, alumina and strontium carbonate are such that the numerical value of the atom ratio Cu/Sr +Al) is from about 0.5 to 4.0, and where in the temperature coefficient of resistance of the fired suppressor which is defined by the expression $$n = 2.303 \log \frac{(R_2)}{(R_1)} \quad \frac{(1)}{T_2 - T_1} \times 100 \text{ in } \%/°C$$

is between about −0.1 %/°C and −1.0%/°C depending upon the value of the Cu/(Sr +Al) atom ratio.

* * * * *